US006240916B1

(12) United States Patent
Huang

(10) Patent No.: US 6,240,916 B1
(45) Date of Patent: Jun. 5, 2001

(54) WIND BOX WITH AN OIL GUIDING DEVICE

(76) Inventor: Sung-Lin Huang, No. 23 Ya Shiu Rd., Ta Ya Tsun Ta Ya Ksiang, Taichung Hsien (TW)

( * ) Notice: Subject to any disclaimer, the term of this patent is extended or adjusted under 35 U.S.C. 154(b) by 0 days.

(21) Appl. No.: 09/484,245

(22) Filed: Jan. 18, 2000

(51) Int. Cl.[7] ..... F24C 15/20

(52) U.S. Cl. ..... 126/299 D; 126/299 R; 55/DIG. 36

(58) Field of Search ..... 126/299 D, 299 R; 55/DIG. 36

(56) References Cited

U.S. PATENT DOCUMENTS 5,230,327 * 7/1993 Jang et al. ..... 126/299 D
5,537,988 * 7/1996 Lin ..... 126/299 D
5,979,436 * 11/1999 Chiang et al. ..... 126/299 D

FOREIGN PATENT DOCUMENTS

2081823 * 11/1992 (CA) ..... 126/84
2133835 * 8/1984 (JP) ..... 126/299 D

* cited by examiner

*Primary Examiner*—Carl D. Price
(74) *Attorney, Agent, or Firm*—Dougherty & Troxell

(57) ABSTRACT

A wind box with an oil guide device includes an oil guide plate and a wind box body. The oil guide plate is assembled with a housing of a smoke exhauster, having oil stop low walls at its peripheral edges to define an oil guide area. The wind box body is fixed on the oil guide plate within the oil guide area so that remaining oil is guided to flow down through an oil outlet formed in oil guide plate and the housing, not spreading to the housing, which is then kept clean.

3 Claims, 5 Drawing Sheets

WIND BOX WITH AN OIL GUIDING DEVICE

BACKGROUND OF THE INVENTION

This invention relates to a wind box with an oil guide device for a smoke exhauster, particularly to one having good function to guide and collect oil, not letting oil to leak out or spread onto a housing of a smoke exhauster.

As shown in FIG. 1, a conventional smoke exhauster 10 has a housing 11 and a wind box 12 welded inside the housing 11. The wind box 12 has two separated chambers 121 for containing an air exhausting system 13, and a smoke passageway 122 formed to communicate with an outside of the housing 11 for smoke to flow out. Further a cover 14 closes the open front side of the housing 11, and each chamber 121 has an air sucking hole 141. When the wind box 12 is combined with the housing 11, as shown in FIGS. 2 and 3, it is fixed on an inner surface 111*a* of the back plate 111 of the housing 11, and the wind box 12 already has a welded rim 123. Then several points of the welded rim 123 are welded with the inner surface 111*a,* with the welded points P securing the wind box with the housing 11. So there are gaps S between the wind box 12 and the housing 11 except the welded points P. Further an oil exhausting tube 124 is provided to extend down from the bottom of the wind box 12 and connected to the two chambers 121, having a plastic tube 125 fitting with an upper end thereof and extend into an oil collect cup 15 so as to guide accumulated oil in the chambers 121 flow down in the oil collect cup 15.

Though the conventional smoke exhauster just described has function of drawing and exhausting smoke, oil L remained everywhere on it is not guided to flow out and very difficult to remove the remained oil L thereon. The reason is that the wind box 12 is not completely sealed up with the inner side 111 a of the back plate 111, but only secured by some welded points, in spite of the oil exhaust tube 124 and the plastic tube 125 guiding oil L to flow in the oil collect cup 15. So there are many gaps S between the wind box 12 and the inner surface 111*a* of the back plate 111 for oil mixed in smoke to spread everywhere in the smoke exhauster and cannot completely guided out by the oil exhaust tube 124. Therefore, everywhere on the inner side of the housing 11 can be seen oil L adhered after the smoke exhauster is used for a period of time. In addition, smoke mixed with oil is drawn and exhausted out by the air exhausting system 13, which is really the main source of remained oil L, as the air exhausting system 13 operates, the fan 131 produces centrifugal force and wind to force oil circulating around its periphery and then out of the gaps S. Then oil may flow everywhere inside the housing 11, resulting in oil also escaping out of any gaps between plates of the housing 11 to adhere on the outside of the housing 11.

SUMMARY OF THE INVENTION

This invention has been devised to offer a wind box with an oil guiding device for a smoke exhauster, which includes an oil guide plate and a wind box body. The oil guide plate is assembled with a housing of the smoke exhauster, having oil stop low walls formed at its peripheral edges for remaining oil only guided to flow down within an oil guide area defined by the oil stop low walls, not spreading onto the housing.

The main feature of the invention is the oil guide plate fixed in the housing of a smoke exhauster. The oil guide plate has oil stop low walls formed along its peripheral edges and the lowest point of the oil low walls has an oil outlet passing through a hole in the bottom of the housing for remaining oil to flow down through into an oil collect cup, preventing remaining oil from spreading onto the housing.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
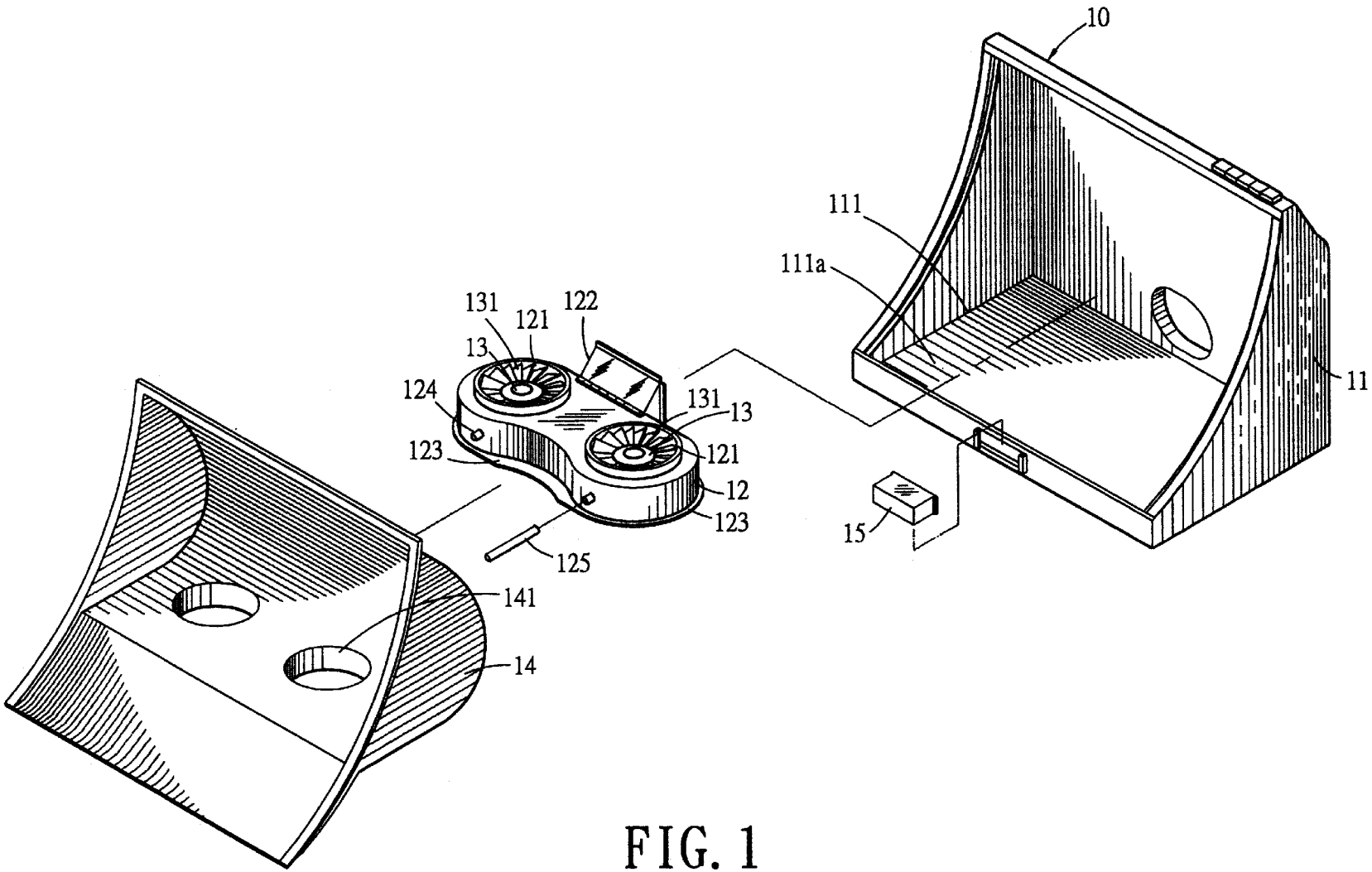
FIG. 1 PRIOR ART
FIG. 1 is an exploded perspective view of a known conventional smoke exhauster.
Figures 2, 3:
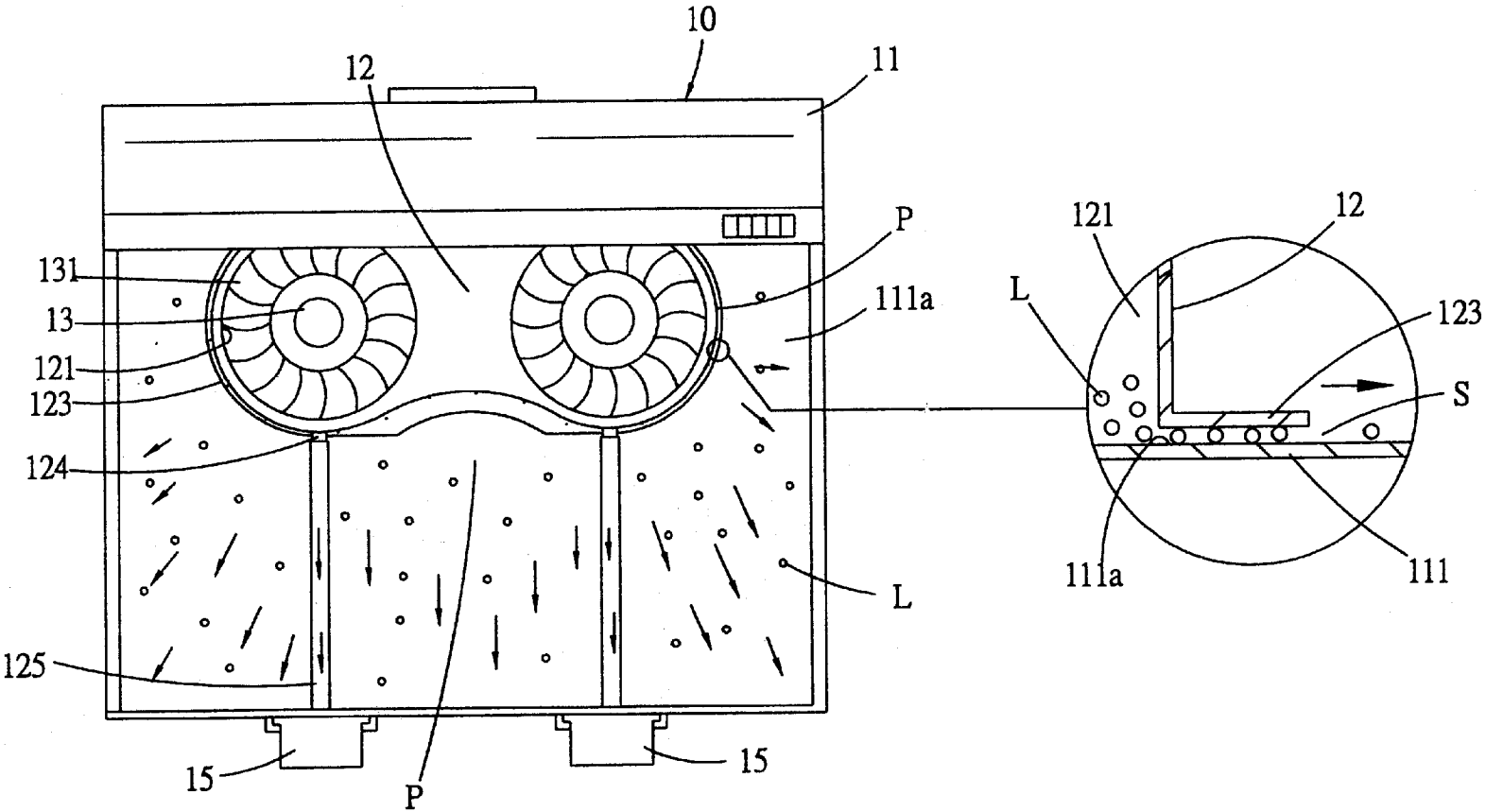
FIG. 2 PRIOR ART
FIG. 3 PRIOR ART
FIG. 2 is a front view of the known conventional smoke exhauster.
FIG. 3 is a magnified side cross-sectional view of a wind box welded with a back plate of the housing of the known conventional smoke exhauster.
Figure 4:
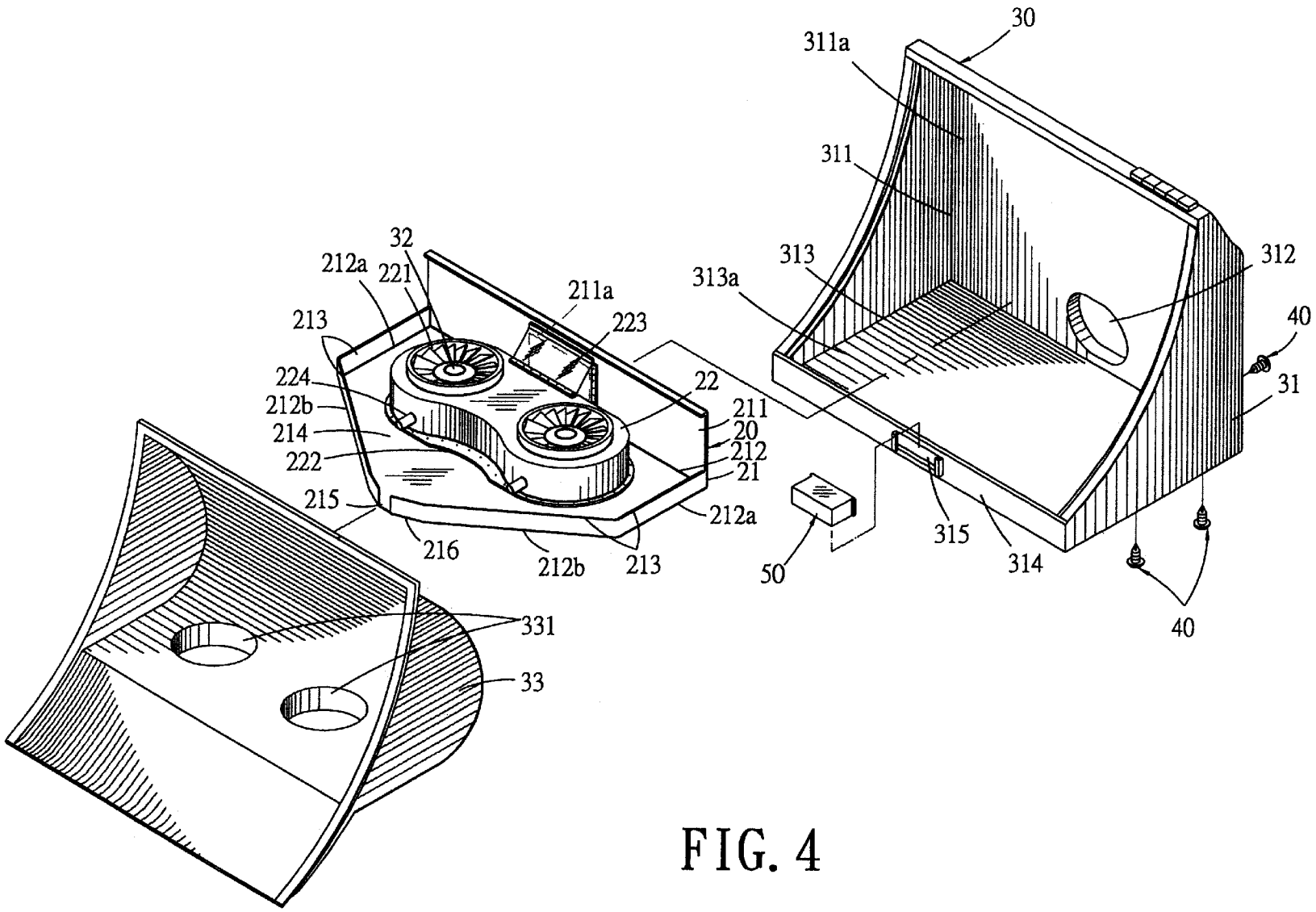
FIG. 4 is an exploded perspective view of a smoke exhauster provided with a wind box with an oil guiding device in the present invention.
Figure 5:
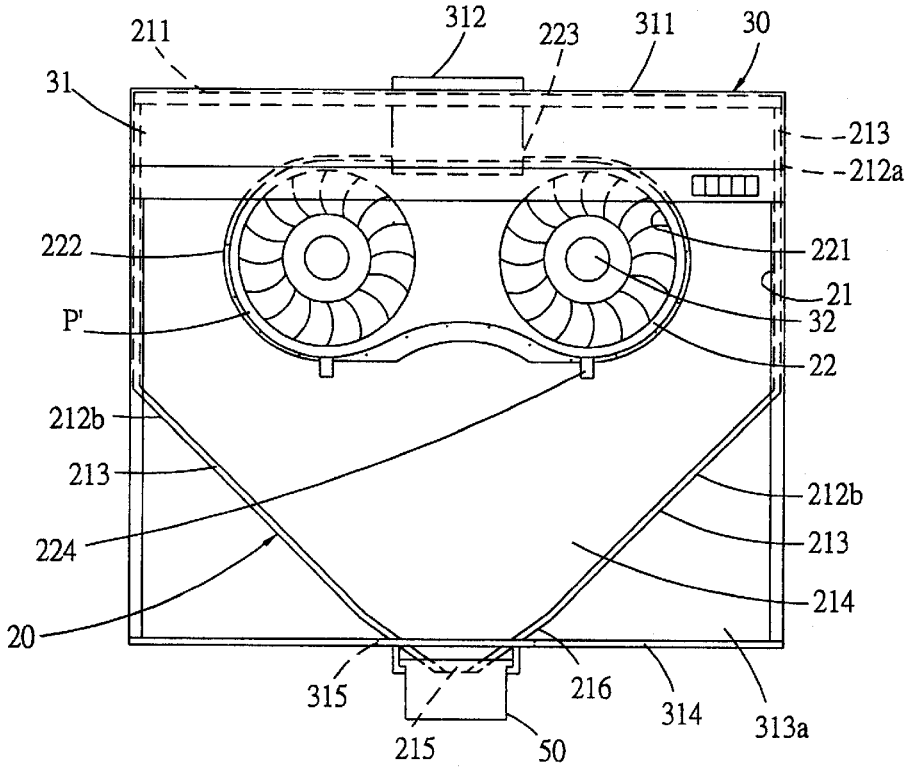
FIG. 5 is a front view of the wind box with an oil guiding device fixed in a smoke exhauster in the present invention.
Figure 6:
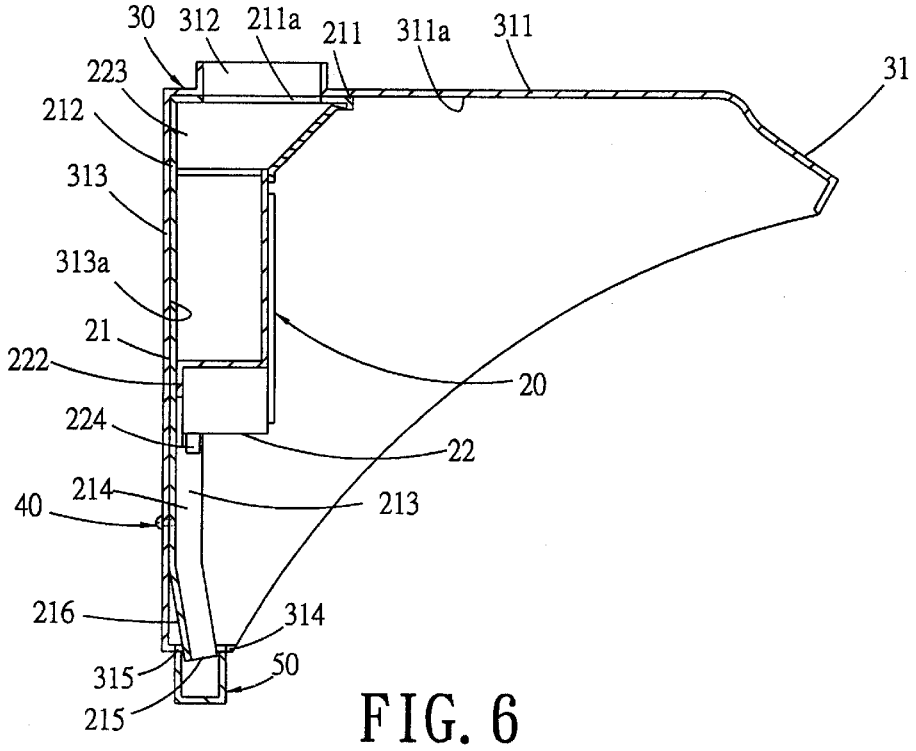
FIG. 6 is a side cross-sectional view of the wind box combined in the housing of a smoke exhauster in the present invention.
Figure 7:
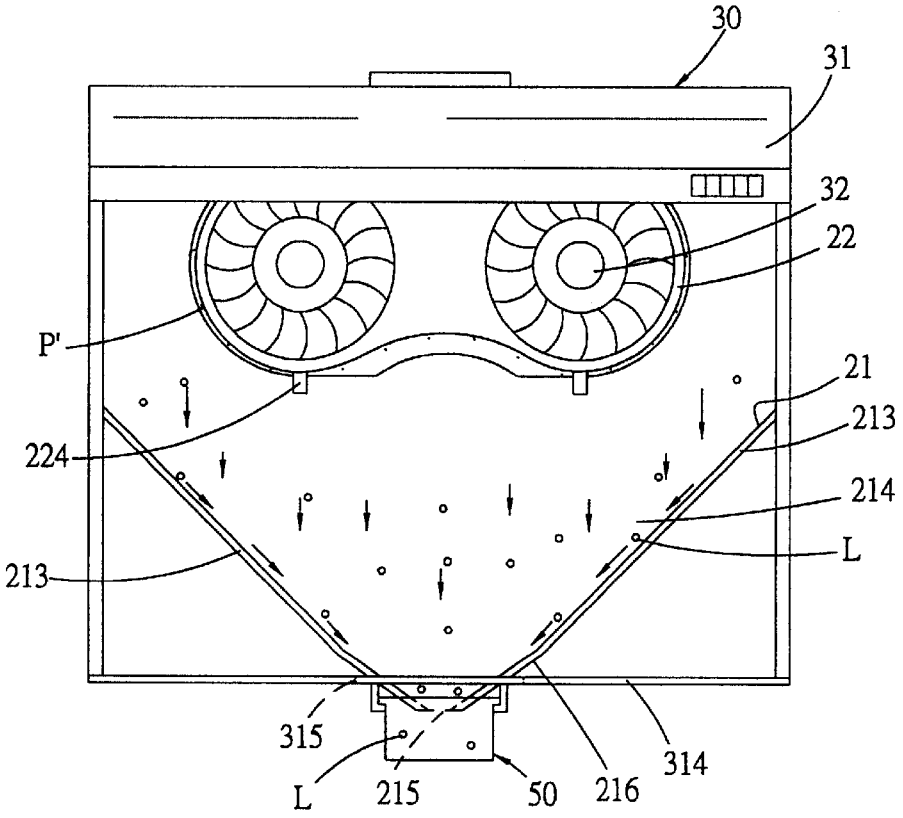
FIG. 7 is a front view of oil mixed in smoke guided to drip down from the oil guiding device in the present invention; and, FIG. 8 is a side view of another embodiment of an oil guiding plate in the present invention.

A preferred embodiment of a wind box with an oil guiding device for a smoke exhauster in the present invention, as shown in FIGS. 4 and 5, includes a wind box body 20 fixed on a housing 31 of a smoke exhauster 30, and two air exhaust system 32 deposited in the wind box body 20. Further, a wind outlet 312 is formed in an upper plate 311 of the housing 31, and a cover 33 closes a front side of the housing 31 and having two wind holes 331.

The wind box 20 consists of an oil guiding plate 21 and a box body 22. The oil guiding plate 21 is made of an integral metal plate, having a horizontal side 212 and a vertical side 211. The horizontal side 212 is laid on an inner surface 313*a* of the upper plate 313 of the housing 31, and the vertical side 211 is laid on an inner surface 311*a* of a back plate 311 of the housing 31. Then the wind box 20 is fixed tightly with the housing by means of screws 40 (in this embodiment tap screws used for benefit of assembling). The horizontal side 212 has a vertical low wall 212*a* formed respectively at the right side and the left side and two sloped vertical low walls 212*b* extending from the two vertical low walls, 212*a* to meet at a lower end point. Further, a continual oil stop edge 213 is formed to bend up a little from upper edges of the vertical low walls 212*a* and 212*b*. Thus, an oil guiding area 214 is defined on the guiding plate 21 by the continual oil stop edge 213, extending along the two sloped low walls 212*b* and an oil outlet 215 formed at the low end meeting point. And each sloped low wall 212*b* has an end curved guide surface 216, permitting the lowest point of the oil guiding area 214 a little sloped to have a small gap from the inner surface 313*a* of the back plate 313. Then the oil outlet 215 may pass through a slot 315 a little, which is formed in the bottom plate 314 of the housing 31, with an oil collecting cup 50 positioned just under the slot 315 for receiving and collecting oil flowing down.

The wind box 20 is made of thin metal, having two chambers 221 of the same shape and size at two sides, and an air exhausting system 32 fixed in each chamber 221, and a peripheral welding edge 222 welded with a slightly upper portion of the horizontal portion 212 of the oil guide plate 21 by means of plural welded points P'. Thus the wind box 22 is located within the oil guiding area 214, surrounded by the oil stopping edge 213. Further, a smoke passageway 223 is welded with the vertical side 211 of the oil guiding plate 21 and on the upper side of the wind box 22, and connected to a through hole 211 a preset in the vertical side 211 of the housing 31. The upper plate 311 of the housing 31 has a wind hole 312 facing the through hole 211 a for smoke to flow out in open air. Further, the wind box 22 has two oil exhausting tubes 224 extending from the bottom of the wind box 22, communicating with the two chambers 221.

Next, the function of the wind box with an oil guiding device is to be described below.

Oil L produced in smoke in the wind box 22 is mainly exhausted through the oil exhausting tube 224, located in the oil guide area 214 of the oil guide plate 21. So remained oil L is limited by the oil stop edge 213 during exhausting smoke, and at the same time it will flow down to the oil outlet 215 and then into the oil collect cup 50. In addition, the welding edge 222 of the wind box 22 is only welded with the oil guide plate 21 with plural welded points P', so the welding edge 222 is not totally welded with the oil guide plate 21, with the rest portions except the welded points not completely sealed. Then remaining oil L will flow through the welding edge 222 of the wind box 22 onto the oil guide plate 21, still adhered around within the oil guiding area 214 to gradually flow down to the oil outlet 215 and then into the oil collect cup 50. Therefore, no matter where remaining oil L may be, it will be hampered by the oil stop edge 213, completely restricted to flow down within the oil guiding area 214. Thus remaining oil L cannot flow onto the inner surface or the outer surface of the housing 31, which is then kept clean, lessening dimensions to be washed, convenient to clean dirty locations. As for the wind box 20, it is easy to be taken off the housing 31 by screwing loose the screws 40, for washing, etc.

Figure 8:
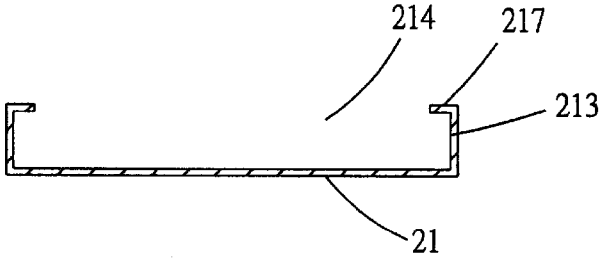

As shown in FIG. 8, the oil guide plate 21 can have another structure, wherein oil stop low walls 213 formed at the right side and the left side, and the stop walls 213 further have an upper bent inward edge 217 for stopping remaining oil L from flowing out of the oil guide area 21, preventing oil L from sipping to the housing 31.

In general, the integral wind box 20 assembled with the oil guide plate 21 can be easily assembled with the housing 31, convenient for workers, and the specially designed oil stop edge 213 and the oil guide area 214 can guide oil L to flow down in the collect cup 50, not spreading to the housing 31, which can be kept clean and easy to wash, very ideal for homemakers.

While the preferred embodiment of the invention has been described and it will be recognized and understood that various modifications may be made therein and the appended claims are intended to cover all such modifications which may fall within the spirit and scope of the invention.

I claim:

1. An integral wind box with an oil guide device comprising: a smoke exhauster having a housing with a smoke passageway formed in an upper portion communicating with an outside of said smoke exhauster: a wind box fixed in the housing, said wind box having at least one oil exhausting tube for oil to flow through, said wind box comprising an oil guide plate and a wind box body, said oil guide plate being fixed in said housing, and having a bottom, a low oil stop wall integrally formed therewith at two sides, said two oil stop walls respectively extending upwardly from the bottom and having spaced apart end portions forming an oil outlet in an oil guide area, said oil outlet passing through a hole formed in a bottom plate of said housing and sticking into an oil collect cup fixed under said hole of said bottom plate for collecting oil flowing down along the oil stop walls, said wind box fixed on said oil guide plate within said oil guide area, wherein said oil guide plate is formed integrally by a thin metal plate, having a first portion fixed on an inner surface of a back plate of said housing and a second portion fixed on an inner surface of an upper plate of said housing, said first portion having the oil stop walls formed on peripheral edges thereof, said oil stop walls having upper sloped edges, the oil guide area being bounded by said oil stop walls, said wind box being directly welded on an upper portion of said oil guide plate and located within said oil guide area, said second portion of said oil guide plate having a through hole connected to a smoke passageway of said wind box for smoke to pass through and to escape out of said housing into open air.

2. The wind box with an oil guide device as claimed in claim 1, wherein said oil guide plate has a sloped curved surface formed in a lower portion separated from said inner surface of said back plate of said housing, permitting said oil outlet to pass through said hole in the bottom of said housing and protrude into said oil collect cup.

3. The wind box with an oil guide device as claimed in claim 1, wherein said oil stop walls have inwardly bent upper edges.

* * * * *